US007832472B2

(12) United States Patent
Themig

(10) Patent No.: US 7,832,472 B2
(45) Date of Patent: Nov. 16, 2010

(54) HYDRAULIC OPEN HOLE PACKER

(75) Inventor: Daniel Jon Themig, Cochrane (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/495,455

(22) Filed: Jun. 30, 2009
(Under 37 CFR 1.47)

(65) Prior Publication Data

US 2009/0283280 A1 Nov. 19, 2009

Related U.S. Application Data

(60) Continuation of application No. 12/058,337, filed on Mar. 28, 2008, now Pat. No. 7,571,765, which is a continuation of application No. 11/550,863, filed on Oct. 19, 2006, now Pat. No. 7,543,634, which is a continuation of application No. 11/104,467, filed on Apr. 13, 2005, now Pat. No. 7,134,505, which is a division of application No. 10/299,004, filed on Nov. 19, 2002, now Pat. No. 6,907,936.

(60) Provisional application No. 60/331,491, filed on Nov. 19, 2001, provisional application No. 60/404,783, filed on Aug. 21, 2002.

(51) Int. Cl.
*E21B 23/06* (2006.01)
*E21B 33/124* (2006.01)

(52) U.S. Cl. ..... 166/191; 166/182; 166/196

(58) Field of Classification Search ..... 166/191, 166/313, 373, 147, 318, 182, 196, 387; 175/61, 175/62

See application file for complete search history.

(56) References Cited

U.S. PATENT DOCUMENTS

| | | | |
|---|---|---|---|
| 1,956,694 | A | 5/1934 | Parrish |
| 2,121,002 | A | 6/1938 | Baker |
| 2,618,340 | A | 11/1952 | Lynd |
| 2,715,444 | A | 8/1955 | Fewel |
| 2,731,827 | A | 1/1956 | Loomis |
| 2,737,244 | A | 3/1956 | Baker et al. |
| 2,780,294 | A | 2/1957 | Loomis |
| 2,807,955 | A | 10/1957 | Loomis |
| 2,836,250 | A | 5/1958 | Brown |
| 2,841,007 | A | 7/1958 | Loomis |
| 2,860,489 | A | 11/1958 | Townsend |
| 3,038,542 | A | 6/1962 | Loomis |
| 3,054,415 | A | 9/1962 | Baker et al. |
| 3,122,205 | A | 2/1964 | Brown et al. |
| 3,153,845 | A | 10/1964 | Loomis |

(Continued)

OTHER PUBLICATIONS

Halliburton Retrievable Service Tools product brochure, undated, 15 pages.

(Continued)

*Primary Examiner*—Kenneth Thompson
(74) *Attorney, Agent, or Firm*—Marlin R. Smith

(57) ABSTRACT

A tubing string assembly is disclosed for fluid treatment of a wellbore. The tubing string can be used for staged wellbore fluid treatment where a selected segment of the wellbore is treated, while other segments are sealed off. The tubing string can also be used where a ported tubing string is required to be run in in a pressure tight condition and later is needed to be in an open-port condition.

57 Claims, 9 Drawing Sheets

U.S. PATENT DOCUMENTS

| | | | | |
|---|---|---|---|---|
| 3,154,940 | A | 11/1964 | Loomis | |
| 3,158,378 | A | 11/1964 | Loomis | |
| 3,165,918 | A | 1/1965 | Loomis | |
| 3,165,919 | A | 1/1965 | Loomis | |
| 3,165,920 | A | 1/1965 | Loomis | |
| 3,193,917 | A | 7/1965 | Loomis | |
| 3,194,310 | A | 7/1965 | Loomis | |
| 3,195,645 | A | 7/1965 | Loomis | |
| 3,199,598 | A | 8/1965 | Loomis | |
| 3,311,169 | A | 3/1967 | Hefley et al. | |
| 4,099,563 | A | 7/1978 | Hutchison et al. | |
| 4,279,306 | A | 7/1981 | Weitz | |
| 4,484,625 | A * | 11/1984 | Barbee, Jr. | 166/185 |
| 4,498,536 | A | 2/1985 | Ross et al. | |
| 4,519,456 | A | 5/1985 | Cochran | |
| 4,520,870 | A | 6/1985 | Pringle | |
| 4,552,218 | A | 11/1985 | Ross et al. | |
| 4,567,944 | A | 2/1986 | Zunkel et al. | |
| 4,569,396 | A | 2/1986 | Brisco | |
| 4,590,995 | A | 5/1986 | Evans et al. | |
| 4,646,829 | A | 3/1987 | Barrington et al. | |
| 4,657,084 | A | 4/1987 | Evans | |
| 4,714,117 | A | 12/1987 | Dech | |
| 4,716,967 | A | 1/1988 | Mohaupt | |
| 4,754,812 | A | 7/1988 | Gentry | |
| 4,791,992 | A | 12/1988 | Greenlee et al. | |
| 4,794,989 | A | 1/1989 | Mills | |
| 4,893,678 | A | 1/1990 | Stokley et al. | |
| 4,967,841 | A | 11/1990 | Murray | |
| 5,103,901 | A | 4/1992 | Greenlee | |
| 5,152,340 | A | 10/1992 | Clark et al. | |
| 5,197,547 | A | 3/1993 | Morgan | |
| 5,454,430 | A | 10/1995 | Kennedy et al. | |
| 5,472,048 | A | 12/1995 | Kennedy et al. | |
| 5,499,687 | A | 3/1996 | Lee | |
| 5,526,880 | A | 6/1996 | Jordan, Jr. et al. | |
| 5,533,573 | A | 7/1996 | Jordan, Jr. et al. | |
| 5,542,473 | A | 8/1996 | Pringle et al. | |
| 5,701,954 | A | 12/1997 | Kilgore et al. | |
| 5,775,429 | A | 7/1998 | Arizmendi et al. | |
| 5,791,414 | A | 8/1998 | Skinner et al. | |
| 5,960,881 | A | 10/1999 | Allamon et al. | |
| 6,041,858 | A | 3/2000 | Arizmendi | |
| 6,047,773 | A | 4/2000 | Zeltmann et al. | |
| 6,112,811 | A | 9/2000 | Kilgore et al. | |
| 6,131,663 | A | 10/2000 | Henley et al. | |
| 6,253,861 | B1 | 7/2001 | Carmichael et al. | |
| 6,279,651 | B1 * | 8/2001 | Schwendemann et al. | 166/54.1 |
| 6,543,545 | B1 | 4/2003 | Chatterji et al. | |
| 6,883,610 | B2 | 4/2005 | Depiak | |
| 6,907,936 | B2 | 6/2005 | Fehr et al. | |
| 7,134,505 | B2 | 11/2006 | Fehr et al. | |
| 7,198,110 | B2 | 4/2007 | Kilgore et al. | |
| 7,231,987 | B2 | 6/2007 | Kilgore et al. | |
| 7,543,634 | B2 | 6/2009 | Fehr et al. | |

OTHER PUBLICATIONS

Halliburton Guiberson® G-77 Hydraulic-Set Retrievable Packer, undated, 6 pages.
Baker Oil Tools, Retrievable Packer Systems product brochure, undated, 1 page.
Drawings, Packer Installation Plan, PACK 05543, 1997, 5 pages.
Guiberson-AVA/Dresser, Retrievable Packer Systems, Tandem Packer, undated, 1 page.
Halliburton Hydraulic-Set Guiberson™ Wizard® Packer, undated, 1 page.
Thomson, D.W., Design and Installation of a Cost-Effective Completion System for Horizontal Chalk Wells Where Multiple Zones Require Acid Stimulation, SPE Drilling and Completion, Sep. 1998, pp. 151-156.
Packers Plus Energy Services, Inc., 5.1 RockSeal™ II Open Hole Packer Series, 2004, 2 pages.
Owen Oil Tools Mechanical Gun Release product brochure, undated, 1 page.
Sapex Oil Tools Ltd., Downhole Completions catalog, undated, 24 pages.
Halliburton, catalog, pp. 51-54, 1957.
Baker Hughes, catalog, pp. 66-73, 1991.
Trahan, Kevin, Affidavit, May 19, 2008.
Trahan, Kevin, Affidavit Exhibit C, May 19, 2008.
Trahan, Kevin, Affidavit Exhibit E, May 19, 2008.
Trahan, Kevin, Affidavit Exhibit G, May 19, 2008.
Baker Oil Tools, catalog, p. 29, Model "C" Packing Element Circulating Washer, Product No. 470-42, Mar. 1997.
Guiberson-AVA Dresser, catalog, front page and pp. 1 & 20, 1994.
Baker Oil Tools, catalog, p. 38, Twin Seal Submersible Pumppacker, undated.
Halliburton, Plaintiffs Fourth Amended Petition in Cause No. CV-44964, 238th Judicial District of Texas, Aug. 13, 2007.
Packers Plus, Second Amended Original Answer in Cause No. CV-44964, 238th Judicial District of Texas, Feb. 13, 2007.
Packers Plus, Original Answer in Cause No. CV-44964, 238th Judicial District of Texas, Feb. 13, 2007.
Guiberson AVA, Packer Installation Plan, Aug. 26, 1997.
Guiberson AVA, Packer Installation Plan, Sep. 9, 1997.
Guiberson AVA, Packer Installation Plan, Nov. 11, 1997.
Guiberson AVA, Wizard II Hydraulic Set Retrievable Packer Tech Manual, Apr. 1998.
Dresser Oil Tools, catalog, Multilateral Completion Tools Section, undated.
Dresser Oil Tools, catalog, Technical Section, title page and p. 18, Nov. 1997.
Berryman, William, First Supplemental Expert Report in Cause No. CV-44964, 238th Judicial District of Texas, undated.
Brown Oil Tools, catalog page, entitled "Brown Hydraulic Set Packers," undated.
Brown Oil Tools, catalog page, entitled "Brown HS-16-1 Hydraulic Set Retrievable Packers," undated.
238th District Court, Midland, Texas, Case No. CV44964, Exhibit 6, Deposition of Daniel Jon Themig, Calgary, Alberta, Canada, dated Jan. 17, 2006, parts 1 and 2 total for a total of 82 pages with redactions from p. 336, Line 10 through all of p. 337.
238th District Court, Midland, Texas, Case No. CV44964, Exhibit 7, Deposition of Daniel Jon Themig, Calgary, Alberta, Canada, dated Jan. 8, 2007, 75 pages with redactions from p. 716, Line 23 through p. 726, Line 22.
238th District Court, Midland, Texas, Case No. CV44964, Exhibit 8, Deposition of Daniel Jon Themig, Calgary, Alberta, Canada, dated Jan. 9, 2007, 46 pages with redactions on p. 850, Lines 13-19.
238th District Court, Midland, Texas, Case No. CV44964, Exhibit 9, Cross-examination of Daniel Jon Themig, In the Court of Queen's Bench of Alberta, Canada, dated Mar. 14, 2005, 67 pages.
238th District Court, Midland, Texas, Case No. CV44964, Exhibit 10, Deposition of William Sloane Muscroft, Edmonton, Alberta, Canada, dated Mar. 31, 2007, parts 1 and 2 for a total of 111 pages.
238th District Court, Midland, Texas, Case No. CV44964, Exhibit 11, Email from William Sloane Muscroft to Peter Krabben dated Jan. 27, 2000, 1 page.
238th District Court, Midland, Texas, Case No. CV44964, Exhibit 12, Email from William Sloane Muscroft to Daniel Jon Themig dated Feb. 1, 2000, 1 page.
238th District Court, Midland, Texas, Case No. CV44964, Exhibit 13, Email from Daniel Jon Themig to William Sloane Muscroft dated Jun. 19, 2000, 2 pages.
First Supplemental Expert Report of Kevin Trahan, Case No. CV-44,964, 238th Judicial District, Midland County, Texas, Aug. 21, 2008, 28 pages.
Order of Dismissal, Case No. CV-44,964, 238th Judicial District, Midland County, Texas, Oct. 14, 2008, 1 page.
Brown Oil Tools General Catalog 1962-63, Hydraulic Set Packers and Hydraulic Set Retrievable Packers, pp. 870-871.

* cited by examiner

HYDRAULIC OPEN HOLE PACKER

CROSS-REFERENCE TO RELATED APPLICATIONS

This application is a continuation of prior application Ser. No. 12/058,337 filed on Mar. 28, 2008 which is a continuation of prior application Ser. No. 11/550,863 filed on Oct. 19, 2006 (now U.S. Pat. No. 7,543,634) which is a continuation of application Ser. No. 11/104,467 filed on Apr. 13, 2005 (now U.S. Pat. No. 7,134,505) which is a division of application Ser. No. 10/299,004 filed on Nov. 19, 2002 (now U.S. Pat. No. 6,907,936) which claims priority to provisional application Ser. No. 60/331,491 filed on Nov. 19, 2001 and to provisional application Ser. No. 60/404,783 filed Aug. 21, 2002. The entire disclosures of these prior applications are incorporated herein by this reference for all purposes.

FIELD OF THE INVENTION

The invention relates to a method and apparatus for wellbore fluid treatment and, in particular, to a method and apparatus for selective communication to a wellbore for fluid treatment.

BACKGROUND OF THE INVENTION

An oil or gas well relies on inflow of petroleum products. When drilling an oil or gas well, an operator may decide to leave productive intervals uncased (open hole) to expose porosity and permit unrestricted wellbore inflow of petroleum products. Alternately, the hole may be cased with a liner, which is then perforated to permit inflow through the openings created by perforating.

When natural inflow from the well is not economical, the well may require wellbore treatment termed stimulation. This is accomplished by pumping stimulation fluids such as fracturing fluids, acid, cleaning chemicals and/or proppant laden fluids to improve wellbore inflow.

In one previous method, the well is isolated in segments and each segment is individually treated so that concentrated and controlled fluid treatment can be provided along the wellbore. Often, in this method a tubing string is used with inflatable element packers thereabout which provide for segment isolation. The packers, which are inflated with pressure using a bladder, are used to isolate segments of the well and the tubing is used to convey treatment fluids to the isolated segment. Such inflatable packers may be limited with respect to pressure capabilities as well as durability under high pressure conditions. Generally, the packers are run for a wellbore treatment, but must be moved after each treatment if it is desired to isolate other segments of the well for treatment. This process can be expensive and time consuming. Furthermore, it may require stimulation pumping equipment to be at the well site for long periods of time or for multiple visits. This method can be very time consuming and costly.

Other procedures for stimulation treatments use foam diverters, gelled diverters and/or limited entry procedures through tubulars to distribute fluids. Each of these may or may not be effective in distributing fluids to the desired segments in the wellbore.

The tubing string, which conveys the treatment fluid, can include ports or openings for the fluid to pass therethrough into the borehole. Where more concentrated fluid treatment is desired in one position along the wellbore, a small number of larger ports are used. In another method, where it is desired to distribute treatment fluids over a greater area, a perforated tubing string is used having a plurality of spaced apart perforations through its wall. The perforations can be distributed along the length of the tube or only at selected segments. The open area of each perforation can be pre-selected to control the volume of fluid passing from the tube during use. When fluids are pumped into the liner, a pressure drop is created across the sized ports. The pressure drop causes approximate equal volumes of fluid to exit each polt in order to distribute stimulation fluids to desired segments of the well. Where there are significant numbers of perforations, the fluid must be pumped at high rates to achieve a consistent distribution of treatment fluids along the wellbore.

In many previous systems, it is necessary to run the tubing string into the bore hole with the ports or perforations already opened. This is especially true where a distributed application of treatment fluid is desired such that a plurality of ports or perforations must be open at the same time for passage therethrough of fluid. This need to run in a tube already including open perforations can hinder the running operation and limit usefulness of the tubing string.

SUMMARY OF THE INVENTION

A method and apparatus has been invented which provides for selective communication to a wellbore for fluid treatment. In one aspect of the invention the method and apparatus provide for staged injection of treatment fluids wherein fluid is injected into selected intervals of the wellbore, while other intervals are closed. In another aspect, the method and apparatus provide for the running in of a fluid treatment string, the fluid treatment string having ports substantially closed against the passage of fluid therethrough, but which are openable when desired to permit fluid flow into the wellbore. The apparatus and methods of the present invention can be used in various borehole conditions including open holes, cased holes, vertical holes, horizontal holes, straight holes or deviated holes.

In one embodiment, there is provided an apparatus for fluid treatment of a borehole, the apparatus comprising a tubing string having a long axis, a first port opened through the wall of the tubing string, a second port opened through the wall of the tubing string, the second port offset from the first port along the long axis of the tubing string, a first packer operable to seal about the tubing string and mounted on the tubing string to act in a position offset from the first port along the long axis of the tubing string, a second packer operable to seal about the tubing string and mounted on the tubing string to act in a position between the first port and the second port along the long axis of the tubing string; a third packer operable to seal about the tubing string and mounted on the tubing string to act in a position offset from the second port along the long axis of the tubing string and on a side of the second port opposite the second packer; a first sleeve positioned relative to the first port, the first sleeve being moveable relative to the first port between a closed port position and a position permitting fluid flow through the first port from the tubing string inner bore and a second sleeve being moveable relative to the second port between a closed port position and a position permitting fluid flow through the second port from the tubing string inner bore; and a sleeve shifting means for moving the second sleeve from the closed port position to the position permitting fluid flow, the means for moving the second sleeve selected to create a seal in the tubing string against fluid flow past the second sleeve through the tubing string inner bore.

In one embodiment, the second sleeve has formed thereon a seat and the means for moving the second sleeve includes a sealing device selected to seal against the seat, such that fluid pressure can be applied to move the second sleeve and the sealing device can seal against fluid passage past the second sleeve. The sealing device can be, for example, a plug or a ball, which can be deployed without connection to surface. Thereby avoiding the need for tripping in a string or wire line for manipulation.

The means for moving the second sleeve can be selected to move the second sleeve without also moving the first sleeve. In one such embodiment, the first sleeve has formed thereon a first seat and the means for moving the first sleeve includes a first sealing device selected to seal against the first seat, such that once the first sealing device is seated against the first seat fluid pressure can be applied to move the first sleeve and the first sealing device can seal against fluid passage past the first sleeve and the second sleeve has formed thereon a second seat and the means for moving the second sleeve includes a second sealing device selected to seal against the second seat, such that when the second sealing device is seated against the second seat pressure can be applied to move the second sleeve and the second sealing device can seal against fluid passage past the second sleeve, the first seat having a larger diameter than the second seat, such that the second sealing device can move past the first seat without sealing thereagainst to reach and seal against the second seat.

In the closed port position, the first sleeve can be positioned over the first port to close the first port against fluid flow therethrough. In another embodiment, the first port has mounted thereon a cap extending into the tubing string inner bore and in the position permitting fluid flow, the first sleeve has engaged against and opened the cap. The cap can be opened, for example, by action of the first sleeve shearing the cap from its position over the port. In another embodiment, the apparatus further comprises a third port having mounted thereon a cap extending into the tubing string inner bore and in the position permitting fluid flow, the first sleeve also engages against the cap of the third port to open it.

In another embodiment, the first port has mounted thereover a sliding sleeve and in the position permitting fluid flow, the first sleeve has engaged and moved the sliding sleeve away from the first port. The sliding sleeve can include, for example, a groove and the first sleeve includes a locking dog biased outwardly therefrom and selected to lock into the groove on the sleeve. In another embodiment, there is a third port with a sliding sleeve mounted thereover and the first sleeve is selected to engage and move the third port sliding sleeve after it has moved the sliding sleeve of the first port.

The packers can be of any desired type to seal between the wellbore and the tubing string. In one embodiment, at least one of the first, second and third packer is a solid body packer including multiple packing elements. In such a packer, it is desirable that the multiple packing elements are spaced apart.

In view of the foregoing there is provided a method for fluid treatment of a borehole, the method comprising: providing an apparatus for wellbore treatment according to one of the various embodiments of the invention; running the tubing string into a wellbore in a desired position for treating the wellbore; setting the packers; conveying the means for moving the second sleeve to move the second sleeve and increasing fluid pressure to wellbore treatment fluid out through the second port.

In one method according to the present invention, the fluid treatment is borehole stimulation using stimulation fluids such as one or more of acid, gelled acid, gelled water, gelled oil, CO.sub.2, nitrogen and any of these fluids containing proppants, such as for example, sand or bauxite. The method can be conducted in an open hole or in a cased hole. In a cased hole, the casing may have to be perforated prior to running the tubing string into the wellbore, in order to provide access to the formation.

In an open hole, preferably, the packers include solid body packers including a solid, extrudable packing element and, in some embodiments, solid body packers include a plurality of extrudable packing elements.

In one embodiment, there is provided an apparatus for fluid treatment of a borehole, the apparatus comprising a tubing string having a long axis, a port opened through the wall of the tubing string, a first packer operable to seal about the tubing string and mounted on the tubing string to act in a position offset from the port along the long axis of the tubing string, a second packer operable to seal about the tubing string and mounted on the tubing string to act in a position offset from the port along the long axis of the tubing string and on a side of the port opposite the first packer; a sleeve positioned relative to the port, the sleeve being moveable relative to the port between a closed port position and a position permitting fluid flow through the port from the tubing string inner bore and a sleeve shifting means for moving the sleeve from the closed port position to the position permitting fluid flow. In this embodiment of the invention, there can be a second port spaced along the long axis of the tubing string from the first port and the sleeve can be moveable to a position permitting flow through the port and the second port.

As noted hereinbefore, the sleeve can be positioned in various ways when in the closed port position. For example, in the closed port position, the sleeve can be positioned over the port to close the port against fluid flow therethrough. Alternately, when in the closed port position, the sleeve can be offset from the port, and the port can be closed by other means such as by a cap or another sliding sleeve which is acted upon, as by breaking open or shearing the cap, by engaging against the sleeve, etc., by the sleeve to open the port.

There can be more than one port spaced along the long axis of the tubing string and the sleeve can act upon all of the ports to open them.

The sleeve can be actuated in any way to move into the position permitted fluid flow through the port. Preferably, however, the sleeve is actuated remotely, without the need to trip a work string such as a tubing string or a wire line. In one embodiment, the sleeve has formed thereon a seat and the means for moving the sleeve includes a sealing device selected to seal against the seat, such that fluid pressure can be applied to move the sleeve and the sealing device can seal against fluid passage past the sleeve.

The first packer and the second packer can be formed as a solid body packer including multiple packing elements, for example, in spaced apart relation.

In view of the forgoing there is provided a method for fluid treatment of a borehole, the method comprising: providing an apparatus for wellbore treatment including a tubing string having a long axis, a port opened through the wall of the tubing string, a first packer operable to seal about the tubing string and mounted on the tubing string to act in a position offset from the port along the long axis of the tubing string, a second packer operable to seal about the tubing string and mounted on the tubing string to act in a position offset from the port along the long axis of the tubing string and on a side of the port opposite the first packer; a sleeve positioned relative to the port, the sleeve being moveable relative to the port between a closed port position and a position permitting fluid flow through the port from the tubing string inner bore and a sleeve shifting means for moving the sleeve from the closed port position to the position permitting fluid flow; running the tubing string into a wellbore in a desired position for treating the wellbore; setting the packers; conveying the means for moving the sleeve to move the sleeve and increasing fluid pressure to permit the flow of wellbore treatment fluid out through the port.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1A:
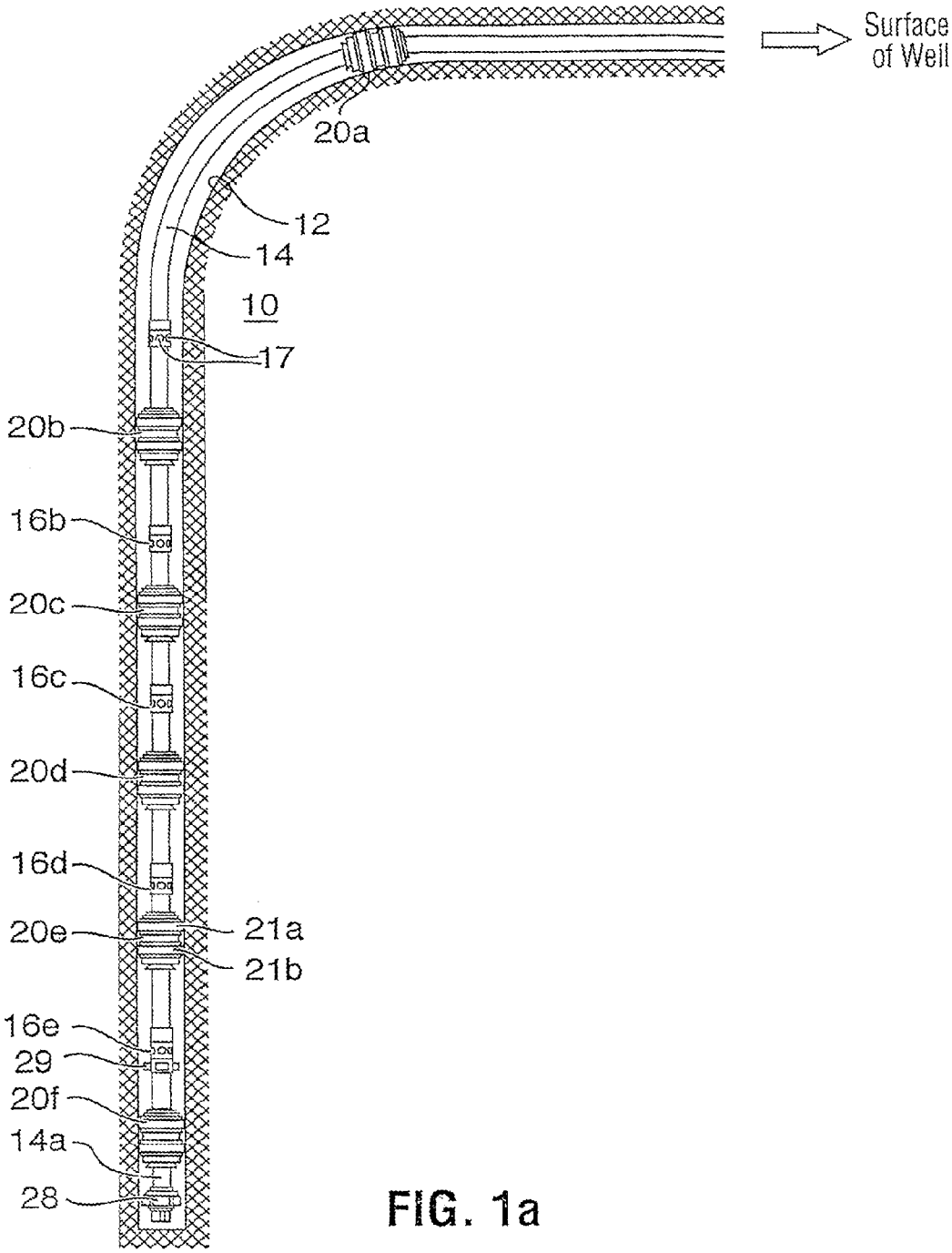
FIG. 1*a* is a sectional view through a wellbore having positioned therein a fluid treatment assembly according to the present invention.
Figure 1B:
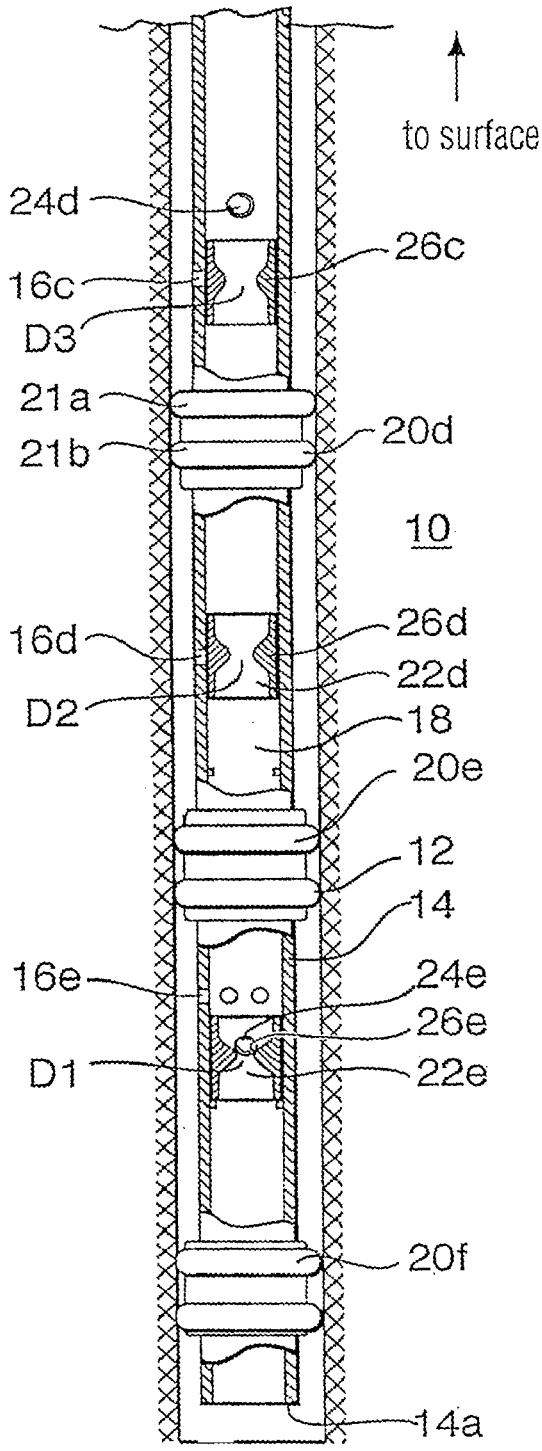
FIG. 1*b* is an enlarged view of a portion of the wellbore of FIG. 1*a* with the fluid treatment assembly also shown in section.

Referring to FIGS. 1*a* and 1*b*, a wellbore fluid treatment assembly is shown, which can be used to effect fluid treatment of a formation 10 through a wellbore 12. The wellbore assembly includes a tubing string 14 having a lower end 14*a* and an upper end extending to surface (not shown). Tubing string 14 includes a plurality of spaced apart ported intervals 16*a* to 16*e* each including a plurality of ports 17 opened through the tubing string wall to permit access between the tubing string inner bore 18 and the wellbore.

A packer 20*a* is mounted between the upper-most ported interval 16*a* and the surface and further packers 20*b* to 20*e* are mounted between each pair of adjacent ported intervals. In the illustrated embodiment, a packer 20*f* is also mounted below the lower most ported interval 16*e* and lower end 14*a* of the tubing string. The packers are disposed about the tubing string and selected to seal the annulus between the tubing string and the wellbore wall, when the assembly is disposed in the wellbore. The packers divide the wellbore into isolated segments wherein fluid can be applied to one segment of the well, but is prevented from passing through the annulus into adjacent segments. As will be appreciated the packers can be spaced in any way relative to the ported intervals to achieve a desired interval length or number of ported intervals per segment. In addition, packer 20*f* need not be present in some applications.

The packers are of the solid body-type with at least one extrudable packing element, for example, formed of rubber. Solid body packers including multiple, spaced apart packing elements 21*a*, 21*b* on a single packer are particularly useful especially for example in open hole (unlined wellbore) operations. In another embodiment, a plurality of packers are positioned in side by side relation on the tubing string, rather than using one packer between each ported interval.

Sliding sleeves 22*c* to 22*e* are disposed in the tubing string to control the opening of the ports. In this embodiment, a sliding sleeve is mounted over each ported interval to close them against fluid flow therethrough, but can be moved away from their positions covering the ports to open the ports and allow fluid flow therethrough. In particular, the sliding sleeves are disposed to control the opening of the ported intervals through the tubing string and are each moveable from a closed port position covering its associated ported interval (as shown by sleeves 22*c* and 22*d*) to a position away from the ports wherein fluid flow of, for example, stimulation fluid is permitted through the ports of the ported interval (as shown by sleeve 22*e*).

The assembly is run in and positioned downhole with the sliding sleeves each in their closed port position. The sleeves are moved to their open position when the tubing string is ready for use in fluid treatment of the wellbore. Preferably, the sleeves for each isolated interval between adjacent packers are opened individually to permit fluid flow to one wellbore segment at a time, in a staged, concentrated treatment process.

Preferably, the sliding sleeves are each moveable remotely from their closed port position to their position permitting through-port fluid flow, for example, without having to run in a line or string for manipulation thereof. In one embodiment, the sliding sleeves are each actuated by a device, such as a ball 24*e* (as shown) or plug, which can be conveyed by gravity or fluid flow through the tubing string. The device engages against the sleeve, in this case ball 24*e* engages against sleeve 22*e*, and, when pressure is applied through the tubing string inner bore 18 from surface, ball 24*e* seats against and creates a pressure differential above and below the sleeve which drives the sleeve toward the lower pressure side.

In the illustrated embodiment, the inner surface of each sleeve which is open to the inner bore of the tubing string defines a seat 26*e* onto which an associated ball 24*e*, when launched from surface, can land and seal thereagainst. When the ball seals against the sleeve seat and pressure is applied or increased from surface, a pressure differential is set up which causes the sliding sleeve on which the ball has landed to slide to an port-open position. When the ports of the ported interval 16*e* are opened, fluid can flow therethrough to the annulus between the tubing string and the wellbore and thereafter into contact with formation 10.

Each of the plurality of sliding sleeves has a different diameter seat and therefore each accept different sized balls. In particular, the lower-most sliding sleeve 22*e* has the smallest diameter D1 seat and accepts the smallest sized ball 24*e* and each sleeve that is progressively closer to surface has a larger seat. For example, as shown in FIG. 1*b*, the sleeve 22*c* includes a seat 26*c* having a diameter D3, sleeve 22*d* includes a seat 26*d* having a diameter D2, which is less than D3 and sleeve 22*e* includes a seat 26*e* having a diameter D1, which is less than D2. This provides that the lowest sleeve can be actuated to open first by first launching the smallest ball 24*e*, which can pass though all of the seats of the sleeves closer to surface but which will land in and seal against seat 26*e* of sleeve 22*e*. Likewise, penultimate sleeve 22*d* can be actuated to move away from potted interval 16*d* by launching a ball 24*d* which is sized to pass through all of the seats closer to surface, including seat 26*c*, but which will land in and seal against seat 26*d*.

Lower end 14*a* of the tubing string can be open, closed or fitted in various ways, depending on the operational characteristics of the tubing string which are desired. In the illustrated embodiment, includes a pump out plug assembly 28. Pump out plug assembly acts to close off end 14*a* during run in of the tubing string, to maintain the inner bore of the tubing string relatively clear. However, by application of fluid pressure, for example at a pressure of about 3000 psi, the plug can be blown out to permit actuation of the lower most sleeve 22*e* by generation of a pressure differential. As will be appreciated, an opening adjacent end 14*a* is only needed where pressure, as opposed to gravity, is needed to convey the first ball to land in the lower-most sleeve. Alternately, the lower most sleeve can be hydraulically actuated, including a fluid actuated piston secured by shear pins, so that the sleeve can be opened remotely without the need to land a ball or plug therein.

In other embodiments, not shown, end 14*a* can be left open or can be closed for example by installation of a welded or threaded plug.

While the illustrated tubing string includes five ported intervals, it is to be understood that any number of ported intervals could be used. In a fluid treatment assembly desired to be used for staged fluid treatment, at least two openable ports from the tubing string inner bore to the wellbore must be provided such as at least two ported intervals or an openable end and one ported interval. It is also to be understood that any number of ports can be used in each interval.

Centralizer 29 and other standard tubing string attachments can be used.

In use, the wellbore fluid treatment apparatus, as described with respect to FIGS. 1*a* and 1*b*, can be used in the fluid treatment of a wellbore. For selectively treating formation 10 through wellbore 12, the above-described assembly is run into the borehole and the packers are set to seal the annulus at each location creating a plurality of isolated annulus zones. Fluids can then pumped down the tubing string and into a selected zone of the annulus, such as by increasing the pressure to pump out plug assembly 28. Alternately, a plurality of open ports or an open end can be provided or lower most sleeve can be hydraulically openable. Once that selected zone is treated, as desired, ball 24*e* or another sealing plug is launched from surface and conveyed by gravity or fluid pressure to seal against seat 26*e* of the lower most sliding sleeve 22*e*, this seals off the tubing string below sleeve 22*e* and opens ported interval 16*e* to allow the next annulus zone, the zone between packer 20*e* and 20*f* to be treated with fluid. The treating fluids will be diverted through the ports of interval 16*e* exposed by moving the sliding sleeve and be directed to a specific area of the formation. Ball 24*e* is sized to pass though all of the seats, including 26*c*, 26*d* closer to surface without sealing thereagainst. When the fluid treatment through ports 16*e* is complete, a ball 24*d* is launched, which is sized to pass through all of the seats, including seat 26*c* closer to surface, and to seat in and move sleeve 22*d*. This opens ported interval 16*d* and permits fluid treatment of the annulus between packers 20*d* and 20*e*. This process of launching progressively larger balls or plugs is repeated until all of the zones are treated. The balls can be launched without stopping the flow of treating fluids. After treatment, fluids can be shut in or flowed back immediately. Once fluid pressure is reduced from surface, any balls seated in sleeve seats can be unseated by pressure from below to permit fluid flow upwardly therethrough.

The apparatus is particularly useful for stimulation of a formation, using stimulation fluids, such as for example, acid, gelled acid, gelled water, gelled oil, $CO_2$, nitrogen and/or proppant laden fluids.

Figure 2:
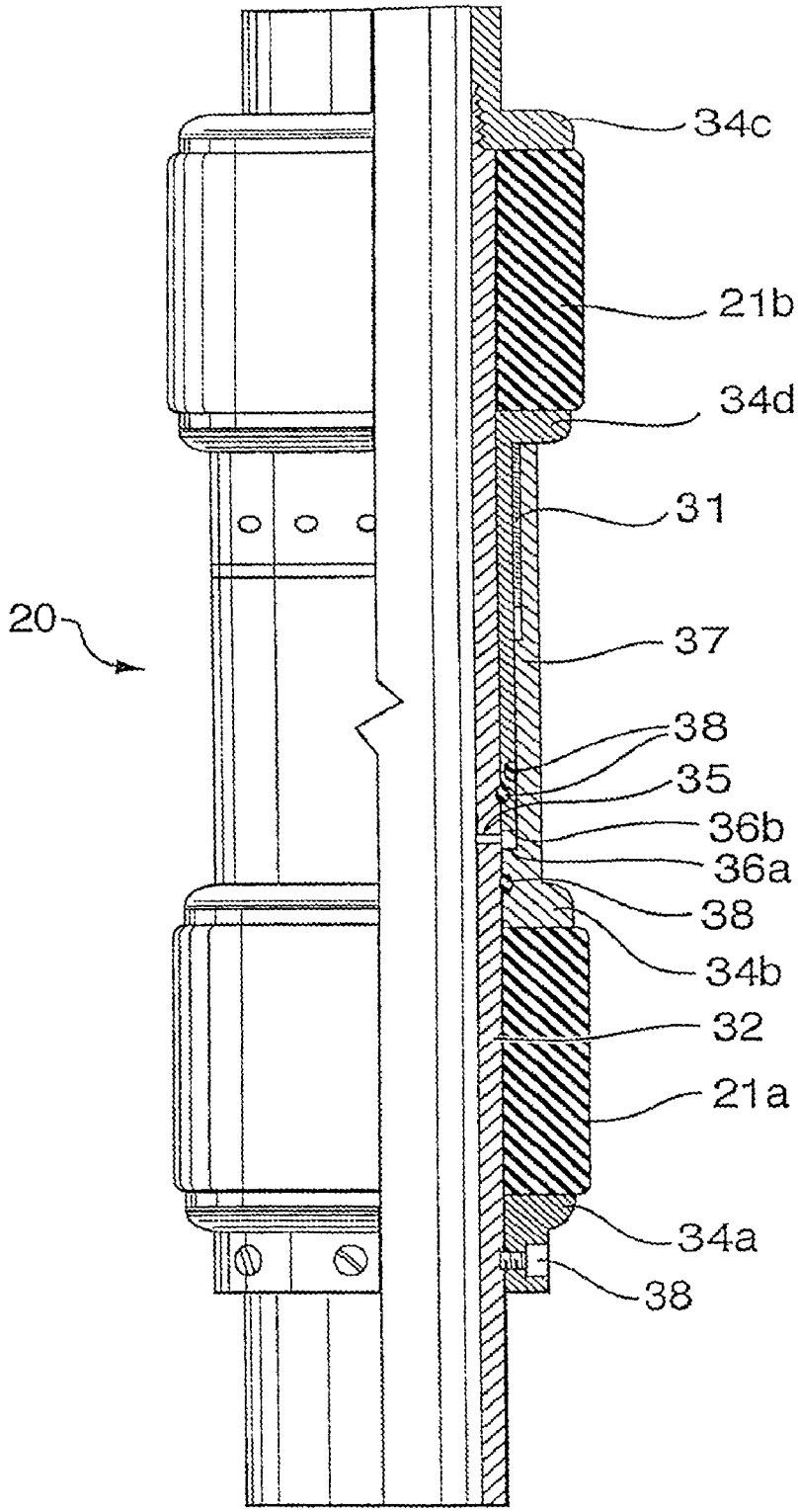
FIG. 2 is a sectional view along the long axis of a packer useful in the present invention.

Referring to FIG. 2, a packer 20 is shown which is useful in the present invention. The packer can be set using pressure or mechanical forces. Packer 20 includes extrudable packing elements 21*a*, 21*b*, a hydraulically actuated setting mechanism and a mechanical body lock system 31 including a locking ratchet arrangement. These parts are mounted on an inner mandrel 32. Multiple packing elements 21*a*, 21*b* are formed of elastomer, such as for example, rubber and include an enlarged cross section to provide excellent expansion ratios to set in oversized holes. The multiple packing elements 21*a*, 21*b* can be separated by at least 0.3 M and preferably 0.8 M or more. This arrangement of packing elements aid in providing high pressure sealing in an open borehole, as the elements load into each other to provide additional pack-off.

Packing element 21*a* is mounted between fixed stop ring 34*a* and compressing ring 34*b* and packing element 21*b* is mounted between fixed stop ring 34*c* and compressing ring 34*d*. The hydraulically actuated setting mechanism includes a port 35 through inner mandrel 32 which provides fluid access to a hydraulic chamber defined by first piston 36*a* and second piston 36*b*. First piston 36*a* acts against compressing ring 34*b* to drive compression and, therefore, expansion of packing element 21*a*, while second piston 36*b* acts against compressing ring 34*d* to drive compression and, therefore, expansion of packing element 21*b*. First piston 36*a* includes a skirt 37, which encloses the hydraulic chamber between the pistons and is telescopically disposed to ride over piston 36*b*. Seals 38 seal against the leakage of fluid between the parts. Mechanical body lock system 31, including for example a ratchet system, acts between skirt 37 and piston 36*b* permitting movement therebetween diving pistons 36*a*, 36*b* away from each other but locking against reverse movement of the pistons toward each other, thereby locking the packing elements into a compressed, expanded configuration.

Thus, the packer is set by pressuring up the tubing string such that fluid enters the hydraulic chamber and acts against pistons 36*a*, 36*b* to drive them apart, thereby compressing the packing elements and extruding them outwardly. This movement is permitted by body lock system 31 but is locked against retraction to lock the packing elements in extruded position.

Ring 34*a* includes shears 38 which mount the ring to mandrel 32. Thus, for release of the packing elements from sealing position the tubing string into which mandrel 32 is connected, can be pulled up to release shears 38 and thereby release the compressing force on the packing elements.

Figure 3A:
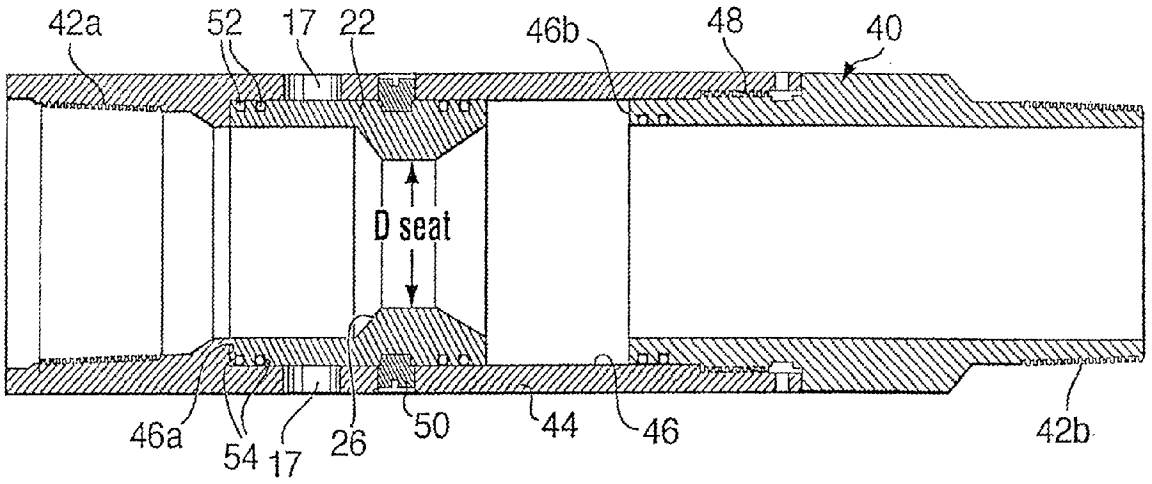
FIG. 3*a* is a sectional view along the long axis of a tubing string sub useful in the present invention containing a sleeve in a closed port position.
Figure 3B:
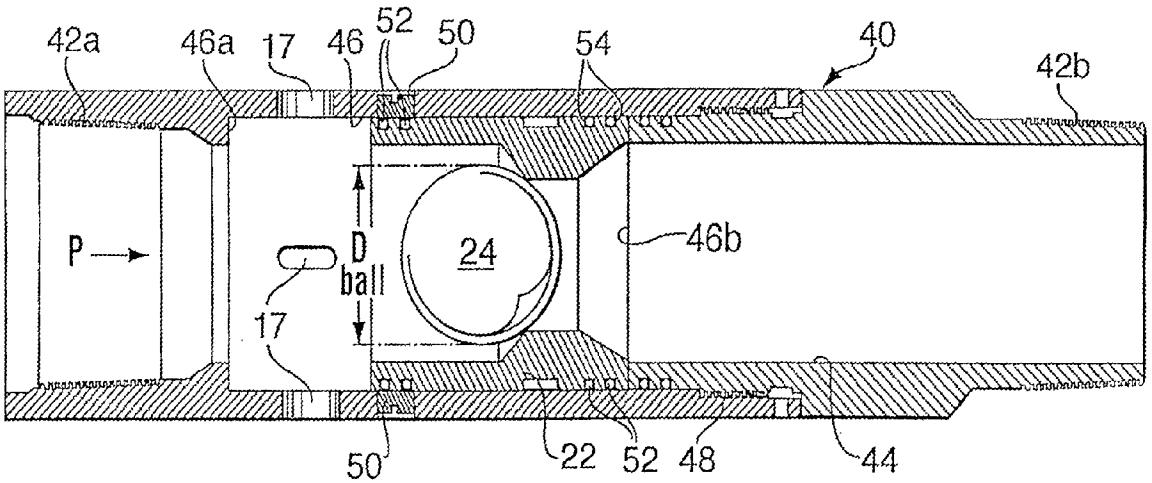
FIG. 3*b* is a sectional view along the long axis of a tubing string sub useful in the present invention containing a sleeve in a position allowing fluid flow through fluid treatment ports.

Referring to FIGS. 3*a* and 3*b*, a tubing string sub 40 is shown having a sleeve 22, positionable over a plurality of ports 17 to close them against fluid flow therethrough and moveable to a position, as shown in FIG. 3*b*, wherein the ports are open and fluid can flow therethrough.

The sub 40 includes threaded ends 42*a*, 42*b* for connection into a tubing string. Sub includes a wall 44 having formed on its inner surface a cylindrical groove 46 for retaining sleeve 22. Shoulders 46*a*, 46*b* define the ends of the groove 46 and limit the range of movement of the sleeve. Shoulders 46*a*, 46*b* can be formed in any way as by casting, milling, etc. the wall material of the sub or by threading parts together, as at connection 48. The tubing string if preferably formed to hold pressure. Therefore, any connection should, in the preferred embodiment, be selected to be substantially pressure tight.

In the closed port position, sleeve 22 is positioned adjacent shoulder 46*a* and over ports 17. Shear pins 50 are secured between wall 44 and sleeve 22 to hold the sleeve in this position. A ball 24 is used to shear pins 50 and to move the sleeve to the port-open position. In particular, the inner facing surface of sleeve 22 defines a seat 26 having a diameter Dseat, and ball 24, is sized, having a diameter Dball, to engage and seal against seat 26. When pressure is applied, as shown by arrows P, against ball 24, shears 50 will release allowing sleeve 22 to be driven against shoulder 46*b*. The length of the sleeve is selected with consideration as to the distance between shoulder 46*b* and ports 17 to permit the ports to be open, to some degree, when the sleeve is driven against shoulder 46*b*.

Preferably, the tubing string is resistant to fluid flow outwardly therefrom except through open ports and downwardly past a sleeve in which a ball is seated. Thus, ball 24 is selected to seal in seat 26 and seals 52, such as o-rings, are disposed in glands 54 on the outer surface of the sleeve, so that fluid bypass between the sleeve and wall 42 is substantially prevented.

Ball 24 can be formed of ceramics, steel, plastics or other durable materials and is preferably formed to seal against its seat.

When sub 40 is used in series with other subs, any subs in the tubing string below sub 40 have seats selected to accept balls having diameters less than Dseat and any subs in the tubing string above sub 40 have seats with diameters greater than the ball diameter Dball useful with seat 26 of sub 40.

Figure 4A:
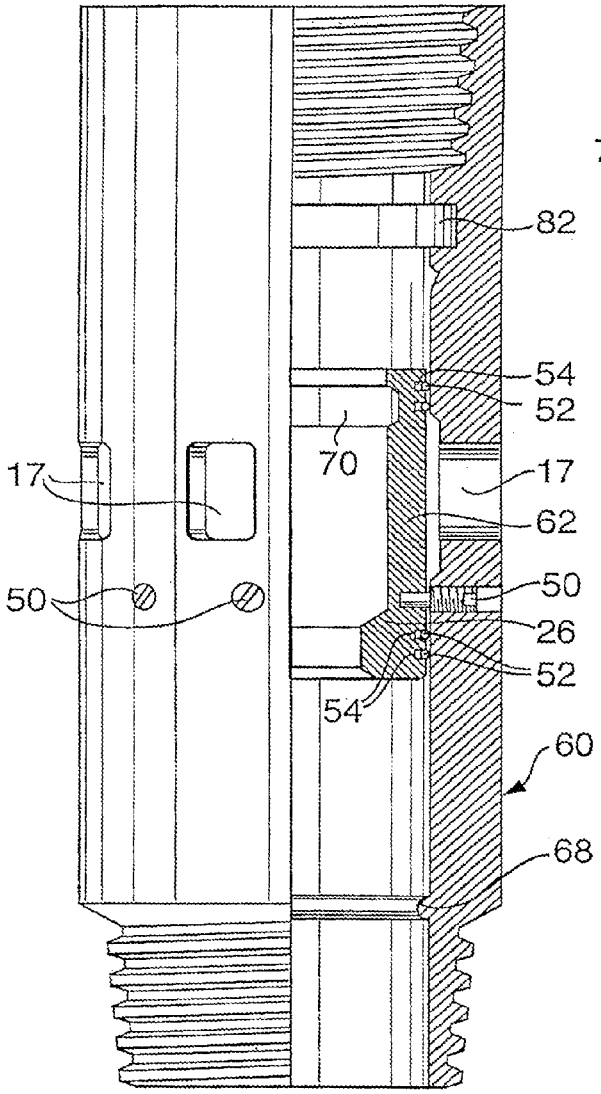
FIG. 4*a* is a quarter sectional view along the long axis of a tubing string sub useful in the present invention containing a sleeve and fluid treatment ports.
Figure 4B:
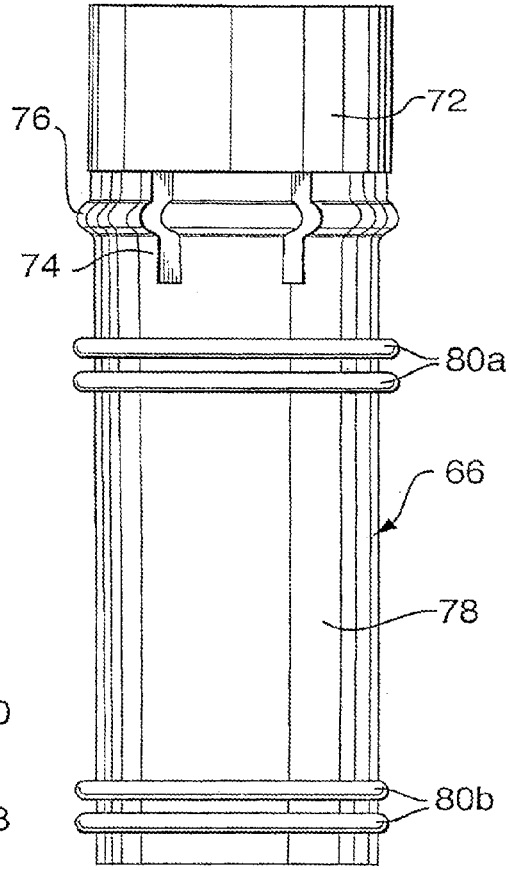
FIG. 4*b* is a side elevation of a flow control sleeve positionable in the sub of FIG. 4*a;*

In one embodiment, as shown in FIG. 4*a*, a sub 60 is used with a retrievable sliding sleeve 62 such that when stimulation and Flow back are completed, the ball activated sliding sleeve can be removed from the sub. This facilitates use of the tubing string containing sub 60 for production. This leaves the ports 17 of the sub open or, alternately, a flow control device 66, such as that shown in FIG. 4*b*, can be installed in sub 60.

In sub 60, sliding sleeve 62 is secured by means of shear pins 50 to cover ports 17.

When sheared out, sleeve 62 can move within sub until it engages against no-go shoulder 68. Sleeve 62 includes a seat 26, glands 54 for seals 52 and a recess 70 for engagement by a retrieval tool (not shown). Since there is no upper shoulder on the sub, the sleeve can be removed by pulling it upwardly, as by use of a retrieval tool on wireline. This opens the tubing string inner bore to facilitate access through the tubing string such as by tools or production fluids. Where a series of these subs are used in a tubing string, the diameter across shoulders 68 should be graduated to permit passage of sleeves therebelow.

Flow control device 66 can be can be installed in any way in the sub. The flow control device acts to control inflow from the segments in the well through ports 17. In the illustrated embodiment, flow control device 66 includes a running neck 72, a lock section 74 including outwardly biased collet fingers 76 or dogs and a flow control section including a solid cylinder 78 and seals 80*a*, 80*b* disposed at either end thereof. Solid cylinder 78 is sized to cover the ports 17 of the sub 60 with seals 80*a*, 80*b* disposed above and below, respectively, the ports. Flow control device 66 can be conveyed by wire line or a tubing string such as coil tubing and is installed by engagement of collet fingers 76 in a groove 82 formed in the sub.

Figure 5:
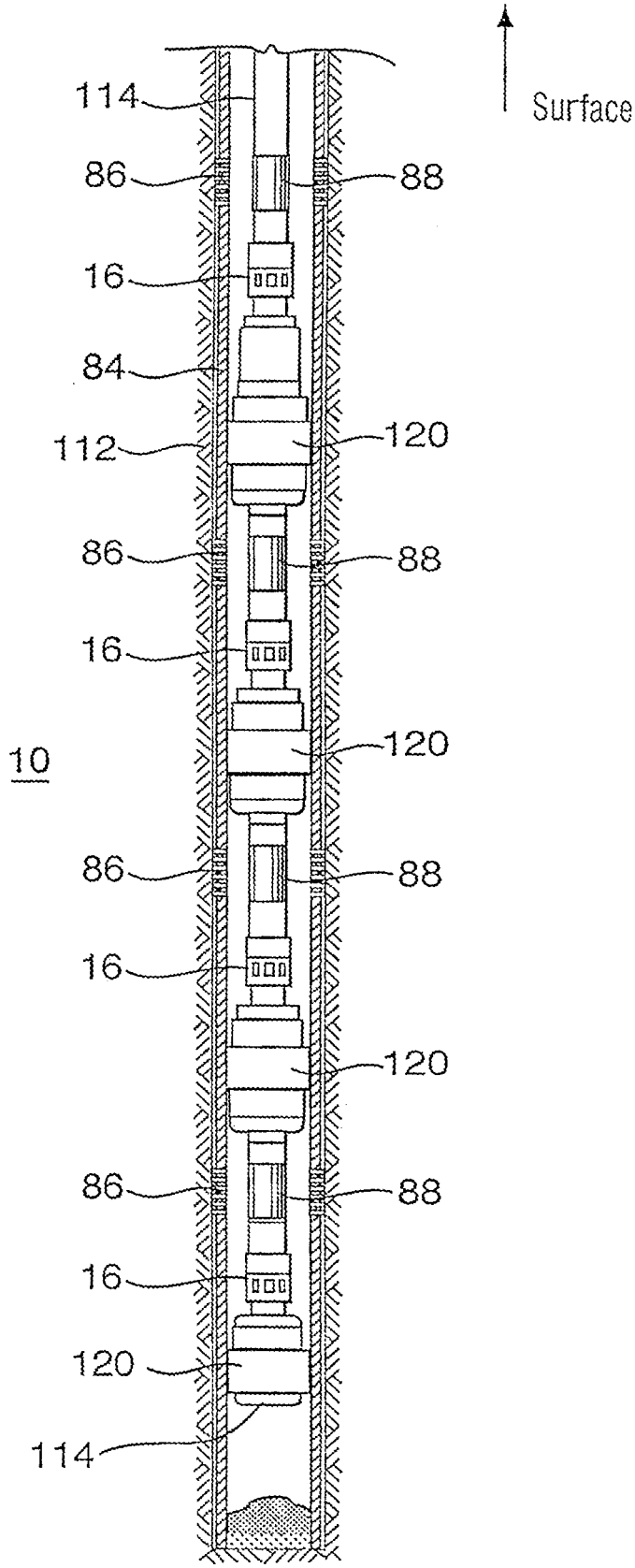
FIG. 5 is a section through another wellbore having positioned therein a fluid treatment assembly according to the present invention.

As shown in FIG. 5, multiple intervals in a wellbore 112 lined with casing 84 can be treated with fluid using an assembly and method similar to that of FIG. 1*a*. In a cased wellbore, perforations 86 are formed thought the casing to provide access to the formation 10 therebehind. The fluid treatment assembly includes a tubing string 114 with packers 120, suitable for use in cased holes, positioned therealong. Between each set of packers is a ported interval 16 through which flow is controlled by a ball or plug activated sliding sleeve (cannot be seen in this view). Each sleeve has a seat sized to permit staged opening of the sleeves. A blast joint 88 can be provided on the tubing string in alignable position with each perforated section. End 114*a* includes a sump valve permitting release of sand during production.

In use, the tubing string is run into the well and the packers are placed between the perforated intervals. If blast joints are included in the tubing string, they arc preferably positioned at the same depth as the perforated sections. The packers are then set by mechanical or pressure actuation. Once the packers are set, stimulation fluids are then pumped down the tubing string. The packers will divert the fluids to a specific segment of the wellbore. A ball or plug is then pumped to shut off the lower segment of the well and to open a siding sleeve to allow fluid to be forced into the next interval, where packers will again divert fluids into specific segment of the well. The process is continued until all desired segments of the wellbore are stimulated or treated. When completed, the treating fluids can be either shut in or flowed back immediately. The assembly can be pulled to surface or left downhole and produced therethrough.

Figure 6A:
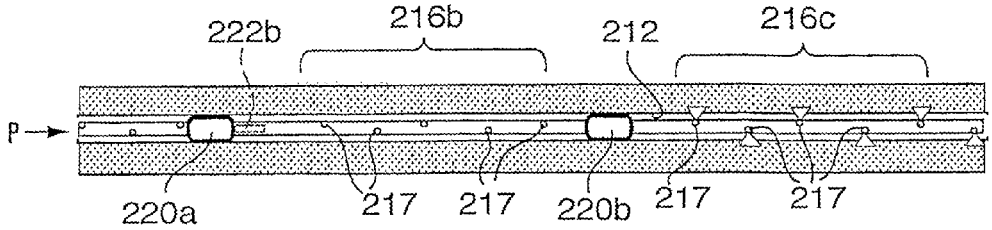
FIG. 6*a* is a section through another wellbore having positioned therein another fluid treatment assembly according to the present invention, the fluid treatment assembly being in a first stage of wellbore treatment.
Figure 6B:
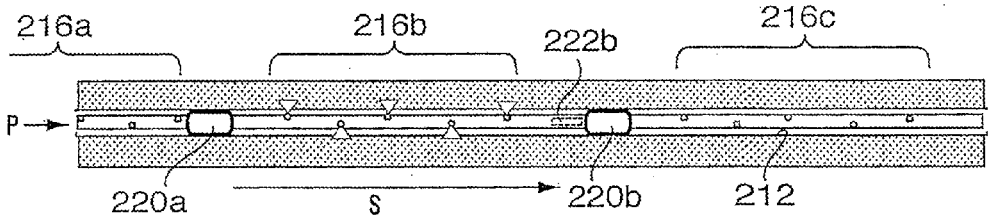
FIG. 6*b* is a section through the wellbore of FIG. 6*a* with the fluid treatment assembly in a second stage of wellbore treatment.
Figure 6C:
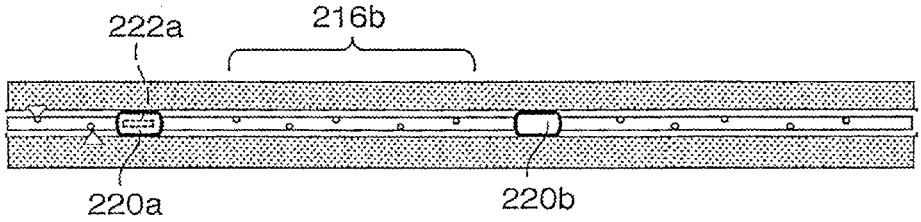
FIG. 6*c* is a section through the wellbore of FIG. 6*a* with the fluid treatment assembly in a third stage of wellbore treatment.

Referring to FIGS. 6*a* to 6*c*, there is shown another embodiment of a fluid treatment apparatus and method according to the present invention. In previously illustrated embodiments, such as FIGS. 1 and 5, each ported interval has included ports about a plane orthogonal to the long axis of the tubing string thus permitting a flow of fluid therethrough which is focused along the wellbore. In the embodiment of FIGS. 6*a* to 6*b*, however, an assembly for fluid treatment by sprinkling is shown, wherein fluid supplied to an isolated interval is introduced in a distributed fashion along a length of that interval. The assembly includes a tubing string 212 and ported intervals 216*a*, 216*b*, 216*c* each including a plurality of ports 217 spaced along the long axis of the tubing string. Packers 220*a*, 220*b* are provided between each interval to form an isolated segment in the wellbore 212.

While the ports of interval 216*c* are open during run in of the tubing string, the ports of intervals 216*b* and 216*a*, are closed during run in and sleeves 222*a* and 222*b* are mounted within the tubing string and actuatable to selectively open the ports of intervals 216*a* and 216*b*, respectively. In particular, in FIG. 6*a*, the position of sleeve 222*b* is shown when the ports of interval 216*b* are closed. The ports in any of the intervals can be size restricted to create a selected pressure drop therethrough, permitting distribution of fluid along the entire ported interval.

Once the tubing string is run into the well, stage 1 is initiated wherein stimulation fluids are pumped into the end section of the well to ported interval 216*c* to begin the stimulation treatment (FIG. 6*a*). Fluids will be forced to the lower section of the well below packer 220*b*. In this illustrated embodiment, the ports of interval 216*c* are normally open size restricted ports, which do not require opening for stimulation fluids to be jetted therethrough. However it is to be understood that the ports can be installed in closed configuration, but opened once the tubing is in place.

When desired to stimulate another section of the well (FIG. 6*b*), a ball or plug (not shown) is pumped by fluid pressure, arrow P, down the well and will seat in a selected sleeve 222*b* sized to accept the ball or plug. The pressure of the fluid behind the ball will push the cutter sleeve against any force, such as a shear pin, holding the sleeve in position and down the tubing string, arrow S. As it moves down, it will open the ports of interval 216*b* as it passes by them in its segment of the tubing string. Sleeve 222*b* reaches eventually stops against a stop means. Since fluid pressure will hold the ball in the sleeve, this effectively shuts off the lower segment of the well including previously treated interval 216*c*. Treating fluids will then be forced through the newly opened ports. Using limited entry or a flow regulator, a tubing to annulus pressure drop insures distribution. The fluid will be isolated to treat the formation between packers 220*a* and 220*b*.

After the desired volume of stimulation fluids are pumped, a slightly larger second ball or plug is injected into the tubing and pumped down the well, and will seat in sleeve 222*a* which is selected to retain the larger ball or plug. The force of the moving fluid will push sleeve 222*a* down the tubing string and as it moves down, it will open the ports in interval 216*a*. Once the sleeve reaches a desired depth as shown in FIG. 6*c*, it will be stopped, effectively shutting off the lower segment of the well including previously treated intervals 216*b* and 216*c*. This process can be repeated a number of times until most or all of the wellbore is treated in stages, using a sprinkler approach over each individual section.

The above noted method can also be used for wellbore circulation to circulate existing wellbore fluids (drilling mud for example) out of a wellbore and to replace that fluid with another fluid. In such a method, a staged approach need not be used, but the sleeve can be used to open ports along the length of the tubing string. In addition, packers need not be used as it is often desirable to circulate the fluids to surface through the wellbore.

The sleeves 222*a* and 222*b* can be formed in various ways to cooperate with ports 217 to open those ports as they pass through the tubing string.

Figure 7:
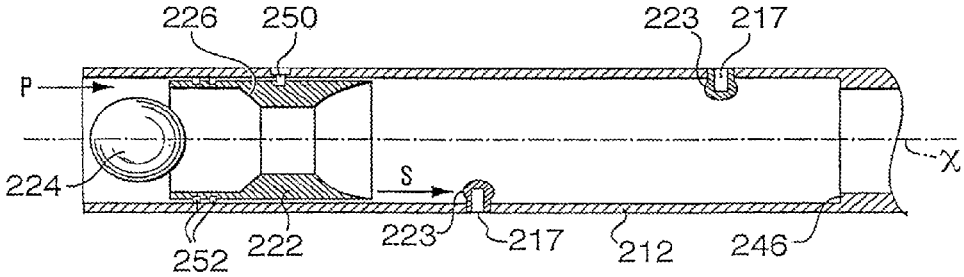
FIG. 7 is a sectional view along the long axis of a tubing string according to the present invention containing a sleeve and axially spaced fluid treatment ports.

With reference to FIG. 7, a tubing string 214 according to the present invention is shown including a movable sleeve 222 and a plurality of normally closed ports 217 spaced along the long axis x of the string. Ports 217 each include a pressure holding, internal cap 223. Cap 223 extends into the bore 218 of the tubing string and is formed of shearable material at least at its base, so that it can be sheared off to open the port. Cap 223 can be, for example, a cobe sub or other modified subs. The caps are selected to be resistant to shearing by movement of a ball therepast.

Sleeve 222 is mounted in the tubing string and includes an outer surface having a diameter to substantially conform to the inner diameter of, but capable of sliding through, the section of the tubing string in which the sleeve is selected to act. Sleeve 222 is mounted in tubing string by use of a shear pin 250 and has a seat 226 formed on its inner facing surface to accept a selected sized ball 224, which when fluid pressure is applied therebehind, arrow P, will shear pin 250 and drive the sleeve, with the ball seated therein along the length of the tubing string until stopped by shoulder 246.

Sleeve 222 includes a profiled leading end 247 which is shear or cut off the protective caps 223 from the ports as it passes, thereby opening the ports. Shoulder 246 is preferably spaced from the ports 217 with consideration as to the length of sleeve 222 such that when the sleeve is stopped against the shoulder, the sleeve does not cover any ports.

Sleeve 222 can include seals 252 to seal between the interface of the sleeve and the tubing string, where it is desired to seal off fluid flow therebetween.

Caps can also be used to close off ports disposed in a plane orthogonal to the long axis of the tubing string, if desired.

Figure 8:
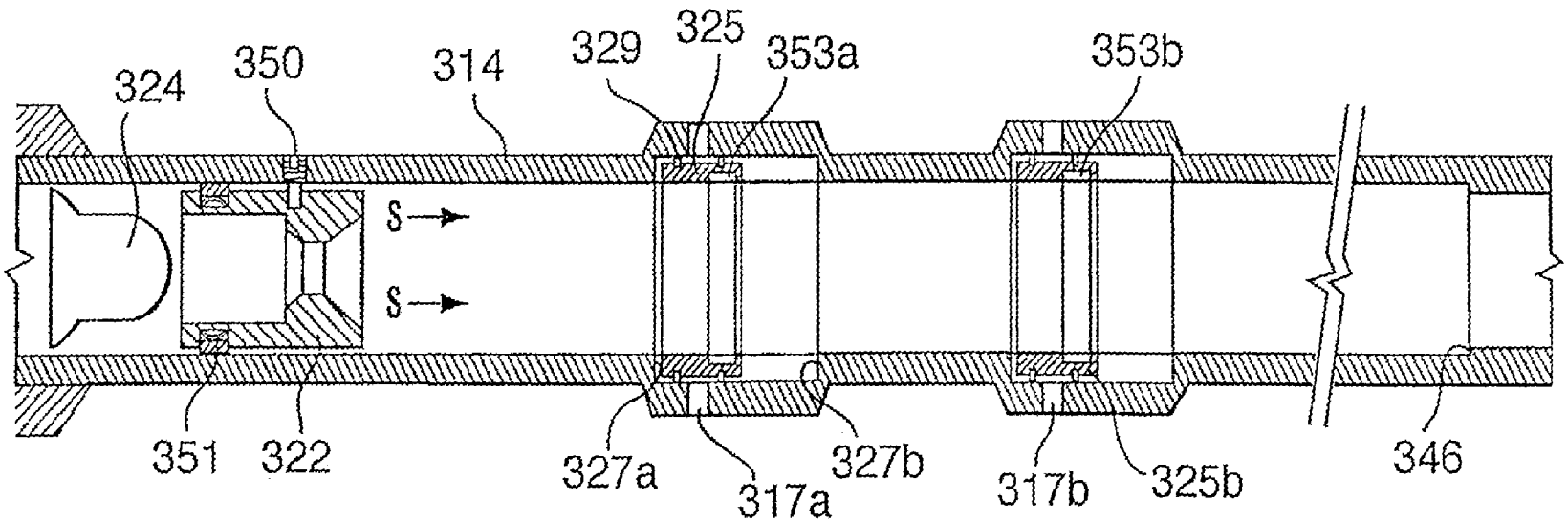
FIG. 8 is a sectional view along the long axis of a tubing string according to the present invention containing a sleeve and axially spaced fluid treatment ports.

Referring to FIG. 8, there is shown another tubing string 314 according to the present invention. The tubing string includes a movable sleeve 322 and a plurality of normally closed ports 317*a*, 317*b* spaced along the long axis x of the string. Sleeve 322, while normally mounted by shear 350, can be moved (arrows S), by fluid pressure created by seating of ball 324 therein, along the tubing string until it butts against a shoulder 346.

Ports 317*a*, 317*b* each include a sliding sleeve 325*a*, 325*b*, respectively, in association therewith. In particular, with reference to port 317*a*, each port includes an associated sliding sleeve disposed in a cylindrical groove, defined by shoulders 327*a*, 327*b* about the port. The groove is formed in the inner wall of the tubing string and sleeve 325*a* is selected to have an inner diameter that is generally equal to the tubing string inner diameter and an outer diameter that substantially conforms to but is slidable along the groove between shoulders 327*a*, 327*b*. Seals 329 are provided between sleeve 325*a* and the groove, such that fluid leakage therebetween is substantially avoided.

Sliding sleeves 325*a* are normally positioned over their associated port 317*a* adjacent shoulder 327*a*, but can be slid along the groove until stopped by shoulder 327*b*. In each case, the shoulder 327*b* is spaced from its port 317*a* with consideration as to the length of the associated sleeve so that when the sleeve is butted against shoulder 327*b*, the port is open to allow at least some-fluid flow therethrough.

The port-associated sliding sleeves 325*a*, 325*b* are each formed to be engaged and moved by sleeve 322 as it passes through the tubing string from its pinned position to its position against shoulder 346. In the illustrated embodiments, sleeves 325*a*, 325*b* are moved by engagement of outwardly biased dogs 351 on the sleeve 322. In particular, each sleeve 325*a*, 325*b* includes a profile 353*a*, 353*b* into which dogs 351 can releasably engage. The spring force of dogs and the configuration of profile 353 are together selected to be greater than the resistance of sleeve 325 moving within the groove, but less than the fluid pressure selected to be applied against ball 324, such that when sleeve 322 is driven through the tubing string, it will engage against each sleeve 325*a* to move it away from its port 317*a* and against its associated shoulder 327*b*. However, continued application of fluid pressure will drive the dogs 351 of the sleeve 322 against their spring force to remove the sleeve from engagement with a first port-associated sleeve 325*a*, along the tubing string 314 and into engagement with the profile 353*b* of the next-port associated sleeve 325*b* and so on, until sleeve 322 is stopped against shoulder 346.

Figure 9A:
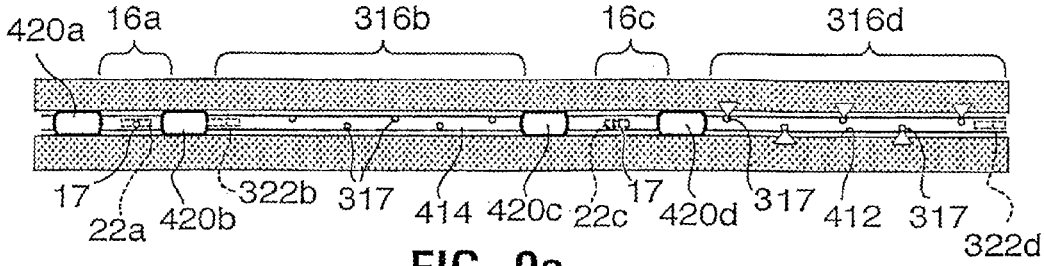
FIG. 9*a* is a section through another wellbore having positioned therein another fluid treatment assembly according to the present invention, the fluid treatment assembly being in a first stage of wellbore treatment.
Figure 9B:
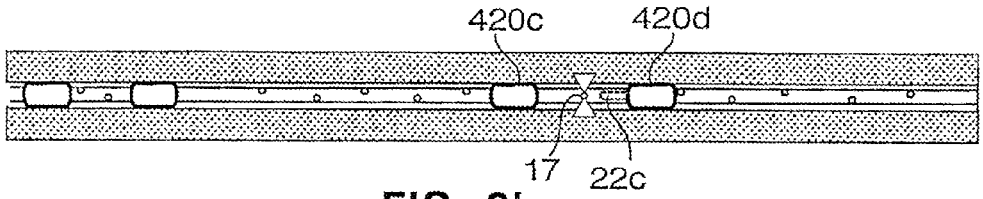
FIG. 9*b* is a section through the wellbore of FIG. 9*a* with the fluid treatment assembly in a second stage of wellbore treatment.
Figure 9C:
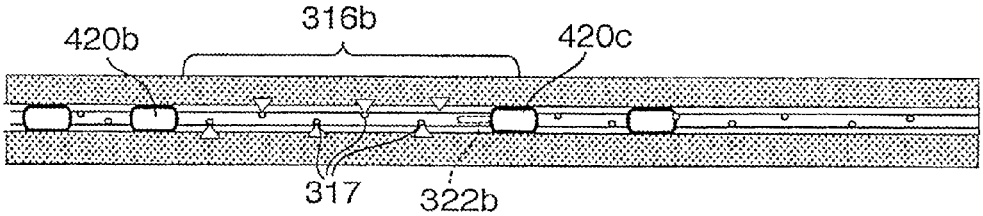
FIG. 9*c* is a section through the wellbore of FIG. 9*a* with the fluid treatment assembly in a third stage of wellbore treatment.

Referring to FIGS. 9*a* to 9*c*, the wellbore fluid treatment assemblies described above with respect to FIGS. 1*a* and 6*a* to can also be combined with a series of ball activated sliding sleeves and packers to allow some segments of the well to be stimulated using a sprinkler approach and other segments of the well to be stimulated using a focused fracturing approach.

In this embodiment, a tubing or casing string 414 is made up with two ported intervals 316*b*, 316*d* formed of subs having a series of size restricted ports 317 therethrough and in which the ports are each covered, for example, with protective pressure holding internal caps and in which each interval includes a movable sleeve 322*b*, 322*d* with profiles that can act as a cutter to cut off the protective caps to open the ports. Other ported intervals 16*a*, 16*c* include a plurality of ports 17 disposed about a circumference of the tubing string and are closed by a ball or plug activated sliding sleeves 22*a*, 22*c*. Packers 420*a*, 420*b*, 420*c*, 420*d* are disposed between each interval to create isolated segments along the wellbore 412.

Figure 9D:
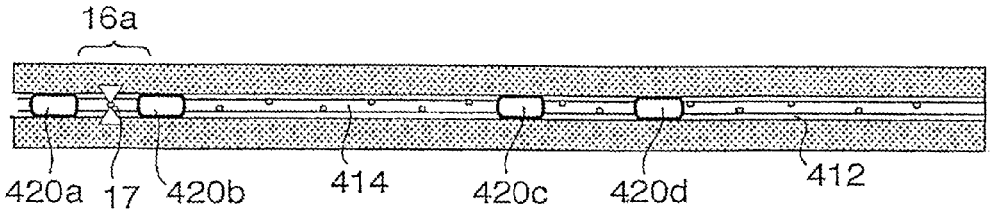
FIG. 9*d* is a section through the wellbore of FIG. 9*a* with the fluid treatment assembly in a fourth stage of wellbore treatment.

Once the system is run into the well (FIG. 9*a*), the tubing string can be pressured to set some or all of the open hole packers. When the packers are set, stimulation fluids are pumped into the end section of the tubing to begin the stimulation treatment, identified as stage 1 sprinkler treatment in the illustrated embodiment. Initially, fluids will be forced to the lower section of the well below packer 420*d*. In stage 2, shown in FIG. 9*b*, a focused frac is conducted between packers 420*c* and 420*d*; in stage 3, shown in FIG. 9*c*, a sprinkler approach is used between packers 420*b* and 420*c*; and in stage 4, shown in FIG. 9*d*, a focused frac is conducted between packers 420*a* and 420*b*.

Sections of the well that use a "sprinkler approach", intervals 316*b*, 316*d*, will be treated as follows: When desired, a ball or plug is pumped down the well, and will seat in one of the cutter sleeves 322*b*, 322*d*. The force of the moving fluid will push the cutter sleeve down the tubing string and as it moves down, it will remove the pressure holding caps from the segment of the well through which it passes. Once the cutter reaches a desired depth, it will be stopped by a no-go shoulder and the ball will remain in the sleeve effectively shutting off the lower segment of the well. Stimulation fluids are then pumped as required.

Segments of the well that use a "focused stimulation approach", intervals 16*a*, 16*c*, will be treated as follows: Another ball or plug is launched and will seat in and shift open a pressure shifted sliding sleeve 22*a*, 22*c*, and block off the lower segment(s) of the well. Stimulation fluids are directed out the ports 17 exposed for fluid flow by moving the sliding sleeve.

Fluid passing through each interval is contained by the packers 420*a* to 420*d* on either side of that interval to allow for treating only that section of the well.

The stimulation process can be continued using "sprinkler" and/or "focused" placement of fluids, depending on the segment which is opened along the tubing string.

What is claimed is:

1. A packer, comprising:

an inner mandrel;

a first compressible packing element disposed around the inner mandrel;

a second compressible packing element disposed around the inner mandrel, wherein said first and second packing elements are spaced apart; and a hydraulic actuation mechanism disposed between the first and second packing elements, wherein said hydraulic actuation mechanism sets the packer by longitudinally compressing the first and second packing elements to seal an annulus in a borehole, and wherein the first and second packing elements load into each other.

2. The packer of claim 1, wherein the hydraulic actuation mechanism comprises a first piston and a second piston, said first and second pistons being positioned adjacent to each other.

3. The packer of claim 2, wherein the first and second pistons define a hydraulic chamber that can be pressurized to set the packer.

4. The packer of claim 3, wherein hydraulic pressure in the hydraulic chamber drives the first and second pistons apart to compress the first and second packing elements at substantially the same time.

5. The packer of claim 3, wherein hydraulic pressure in the hydraulic chamber drives the first and second pistons in opposite directions to compress the first and second packing elements at substantially the same time.

6. The packer of claim 1, wherein the first and second packing elements collectively cover approximately ⅓ of a length of the inner mandrel when the first and second packing elements are in an uncompressed state.

7. The packer of claim 1, wherein the inner mandrel comprises a first end and a second end, wherein the first packing element is disposed proximate the first end, and wherein the second packing element is disposed proximate the second end.

8. The packer of claim 1, wherein a pressure differential applied across at least one of the first and second packing elements causes a compressive load to be applied to the other of the first and second packing elements.

9. The packer of claim 1, wherein the packer is free of any slips for gripping engagement with the borehole.

10. The packer of claim 1, wherein the first and second packing elements provide redundant sealing, in that one of the first and second packing elements remains effective to seal if the other of the first and second packing elements fails to seal.

11. A packer, comprising:

an inner mandrel having first and second opposite ends;

a first compressible packing element disposed around the inner mandrel proximate the first end;

a second compressible packing element disposed around the inner mandrel proximate the second end, wherein said first and second packing elements are spaced apart; and a hydraulic actuation mechanism disposed between the first and second packing elements, wherein said hydraulic actuation mechanism sets the packer by longitudinally compressing the first and second packing elements at substantially the same time to seal an annulus in a borehole in response to pressure applied to said hydraulic actuation mechanism, wherein the hydraulic actuation mechanism comprises a first piston disposed around the inner mandrel and a second piston disposed around the inner mandrel, the first and second pistons define a hydraulic chamber that can be pressurized to set the packer, hydraulic pressure in the hydraulic chamber drives the first and second pistons in opposite directions to compress the first and second packing elements, the first and second pistons are positioned adjacent to each other, and the first and second packing elements collectively cover approximately ⅓ of a length of the inner mandrel when the first and second packing elements are in an uncompressed state.

12. The packer of claim 11, wherein hydraulic pressure in the hydraulic chamber drives the first and second pistons apart to compress the first and second packing elements.

13. The packer of claim 11, wherein the first and second packing elements load into each other.

14. The packer of claim 11, wherein a pressure differential applied across at least one of the first and second packing elements causes a compressive load to be applied to the other of the first and second packing elements.

15. The packer of claim 11, wherein the packer is free of any slips for gripping engagement with the borehole.

16. The packer of claim 11, wherein the inner mandrel is a single member extending between the first and second opposite ends.

17. The packer of claim 11, wherein the first and second packing elements provide redundant sealing, in that one of the first and second packing elements remains effective to seal if the other of the first and second packing elements fails to seal.

18. A well system, comprising:

a packer positioned in a non-vertical open borehole, wherein the packer comprises:

an inner mandrel;

a first compressible packing element disposed around the inner mandrel;

a second compressible packing element disposed around the inner mandrel, wherein said first and second packing elements are spaced apart; and a hydraulic actuation mechanism disposed between the first and second packing elements, wherein said hydraulic actuation mechanism sets the packer by longitudinally compressing the first and second packing elements to seal an annulus in the borehole, and wherein the first and second packing elements load into each other.

19. A well system, comprising:

a packer positioned in a non-vertical open borehole, wherein the packer comprises:

an inner mandrel;

a first compressible packing element disposed around the inner mandrel;

a second compressible packing element disposed around the inner mandrel, wherein said first and second packing elements are spaced apart; and a hydraulic actuation mechanism disposed between the first and second packing elements, wherein said hydraulic actuation mechanism sets the packer by longitudinally compressing the first and second packing elements to seal an annulus in the borehole, and wherein a pressure differential applied across at least one of the first and second packing elements causes a compressive load to be applied to the other of the first and second packing elements.

20. A method for sealing an annulus in a borehole, the method comprising the steps of:

inserting a packer into the borehole on a tubing string, the packer comprising an inner mandrel, a first compressible packing element disposed around the inner mandrel, a second compressible packing element disposed around the inner mandrel, wherein said first and second packing elements are spaced apart, and a hydraulic actuation mechanism between the first and second packing elements;

applying hydraulic pressure to the tubing string until the hydraulic actuation mechanism of the packer actuates, thereby longitudinally compressing the first and second packing elements and sealing the annulus in the borehole; and loading the first and second packing elements into each other.

21. The method of claim 20, wherein the hydraulic actuation mechanism comprises a first piston and a second piston.

22. The method of claim 21, wherein the first and second pistons define a hydraulic chamber.

23. The method of claim 22, wherein the step of applying hydraulic pressure to the tubing string includes applying hydraulic pressure to the hydraulic chamber and driving the first and second pistons in opposite directions to compress the first and second packing elements at substantially the same time.

24. The method of claim 20, wherein prior to the hydraulic pressure applying step, the first and second packing elements collectively cover approximately ⅓ of a length of the inner mandrel.

25. The method of claim 20, wherein in the inserting step, the borehole is an open borehole.

26. The method of claim 20, wherein in the inserting step, the borehole is a non-vertical open borehole.

27. The method of claim 20, wherein the inner mandrel comprises a first end and a second end, wherein the first packing element is disposed proximate the first end, and wherein the second packing element is disposed proximate the second end.

28. The method of claim 20, wherein the packer is free of any slips for gripping engagement with the borehole.

29. The method of claim 20, wherein the first and second packing elements provide redundant sealing, in that one of the first and second packing elements remains effective to seal if the other of the first and second packing elements fails to seal.

30. The method of claim 20, further comprising the step of applying a pressure differential across at least one of the first and second packing elements, thereby causing a compressive load to be applied to the other of the first and second packing elements.

31. A method for sealing an annulus of a horizontal open borehole, the method comprising the steps of:

inserting a packer into the horizontal open borehole on a tubing string, the packer comprising an inner mandrel comprising a first end and a second end, a first compressible packing element disposed around the inner mandrel proximate the first end, a second compressible packing element disposed around the inner mandrel proximate the second end, wherein said first and second packing elements are spaced apart, and a hydraulic actuation mechanism between the first and second packing elements; and applying hydraulic pressure to the tubing string until the hydraulic actuation mechanism of the packer actuates, thereby longitudinally compressing the first and second packing elements and sealing the annulus in the horizontal open borehole, wherein the hydraulic pressure applying step includes loading the first and second packing elements into each other.

32. A method for sealing an annulus of a horizontal open borehole, the method comprising the steps of:

inserting a packer into the horizontal open borehole on a tubing string, the packer comprising an inner mandrel comprising a first end and a second end, a first compressible packing element disposed around the inner mandrel proximate the first end, a second compressible packing element disposed around the inner mandrel proximate the second end, wherein said first and second packing elements are spaced apart, and a hydraulic actuation mechanism between the first and second packing elements; and applying hydraulic pressure to the tubing string until the hydraulic actuation mechanism of the packer actuates, thereby longitudinally compressing the first and second packing elements and sealing the annulus in the horizontal open borehole, wherein the first and second packing elements provide redundant sealing, in that one of the first and second packing elements remains effective to seal if the other of the first and second packing elements fails to seal.

33. A method for sealing an annulus of a horizontal open borehole, the method comprising the steps of:

inserting a packer into the horizontal open borehole on a tubing string, the packer comprising an inner mandrel comprising a first end and a second end, a first compressible packing element disposed around the inner mandrel proximate the first end, a second compressible packing element disposed around the inner mandrel proximate the second end, wherein said first and second packing elements are spaced apart, and a hydraulic actuation mechanism between the first and second packing elements;

applying hydraulic pressure to the tubing string until the hydraulic actuation mechanism of the packer actuates, thereby longitudinally compressing the first and second packing elements and sealing the annulus in the horizontal open borehole; and applying a pressure differential across at least one of the first and second packing elements, and thereby causing a compressive load to be applied to the other of the first and second packing elements.

34. A well system, comprising:

at least one packer set in an open borehole, the packer comprising spaced apart first and second packing elements on a generally tubular mandrel, and a hydraulically actuated setting mechanism positioned between the first and second packing elements, an annular area being defined longitudinally between the first and second packing elements and radially between the packer and the open borehole, and fluid communication being substantially prevented between the annular area and an interior of the mandrel.

35. The well system of claim 34, wherein the annular area is free of any packing element therein.

36. The well system of claim 34, wherein the generally tubular mandrel comprises a single one piece member.

37. The well system of claim 34, wherein compressive force is transmitted between the first and second packing elements via a locking mechanism.

38. The well system of claim 34, wherein the setting mechanism includes inner and outer pistons which apply substantially equal but oppositely directed compression forces directly to the respective first and second packing elements, wherein the packer further comprises a mechanical locking mechanism which permits relative displacement between the inner and outer pistons in a first direction, but which prevents relative displacement between the inner and outer pistons in a second direction opposite to the first direction, and wherein the first and second packing elements load into each other via the locking mechanism.

39. The well system of claim 34, further comprising a tubular string, the packer being interconnected in the tubular string, and spaced apart first and second annuli being defined radially between the tubular string and the open borehole, the first annulus and the annular area being substantially pressure isolated from each other by the first packing element, and the second annulus and the annular area being substantially pressure isolated from each other by the second packing element, and wherein fluid communication is substantially prevented between the annular area and each of the first and second annuli.

40. The well system of claim 34, wherein the first and second packing elements provide redundant sealing, in that one of the first and second packing elements remains effective to seal if the other of the first and second packing elements fails to seal.

41. The well system of claim 34, wherein a pressure differential applied across at least one of the first and second packing elements causes a compressive load to be applied to the other of the first and second packing elements.

42. A method for sealing an annulus of an open borehole, the method comprising the steps of:

inserting a packer into the open borehole on a tubing string; and setting the packer by applying pressure to the tubing string, the setting step including displacing a first piston relative to a second piston in a first direction to thereby apply a compression force to each of first and second packing elements spaced apart on a mandrel of the packer, the first piston radially outwardly overlapping the second piston, the first and second pistons being positioned between the first and second packing elements, and a mechanical locking mechanism preventing displacement of the first piston relative to the second piston in a second direction opposite to the first direction, wherein the first and second packing elements load into each other via the locking mechanism.

43. A method for sealing an annulus of an open borehole, the method comprising the steps of:

inserting a packer into the open borehole on a tubing string; and setting the packer by applying pressure to the tubing string, the setting step including displacing a first piston relative to a second piston in a first direction to thereby apply a compression force to each of first and second packing elements spaced apart on a mandrel of the packer, the first piston radially outwardly overlapping the second piston, the first and second pistons being positioned between the first and second packing elements, and a mechanical locking mechanism preventing displacement of the first piston relative to the second piston in a second direction opposite to the first direction, wherein the first and second packing elements provide redundant sealing, in that one of the first and second packing elements remains effective to seal if the other of the first and second packing elements fails to seal.

44. A method for sealing an annulus of an open borehole, the method comprising the steps of:

inserting a packer into the open borehole on a tubing string;

setting the packer by applying pressure to the tubing string, the setting step including displacing a first piston relative to a second piston in a first direction to thereby apply a compression force to each of first and second packing elements spaced apart on a mandrel of the packer, the first piston radially outwardly overlapping the second piston, the first and second pistons being positioned between the first and second packing elements, and a mechanical locking mechanism preventing displacement of the first piston relative to the second piston in a second direction opposite to the first direction; and applying a pressure differential across at least one of the first and second packing elements, and thereby causing a compressive load to be applied to the other of the first and second packing elements.

45. A well system, comprising:

at least one packer set in a horizontal open borehole, the packer comprising:

spaced apart first and second packing elements on a single one piece generally tubular mandrel, a hydraulically actuated setting mechanism positioned between the first and second packing elements, the setting mechanism including inner and outer pistons which apply substantially equal but oppositely directed compression forces to the respective first and second packing elements, the outer piston radially outwardly overlapping the inner piston, and a mechanical locking mechanism which permits relative displacement between the inner and outer pistons in a first direction, but which prevents relative displacement between the inner and outer pistons in a second direction opposite to the first direction, the first and second packing elements loading into each other via the locking mechanism, and the locking mechanism being positioned between the first and second packing elements;

and wherein an annular area is defined longitudinally between the first and second packing elements and radially between the packer and the horizontal open borehole, fluid communication is substantially prevented between the annular area and an interior of the mandrel, the annular area is free of any packing element therein, the packer is interconnected in a tubular string, spaced apart first and second annuli are defined radially between the tubular string and the borehole, the first annulus and the annular area are pressure isolated from each other by the first packing element, the second annulus and the annular area are pressure isolated from each other by the second packing element, fluid communication is substantially prevented between the first and second annuli, both of the first and second packing elements prevent fluid communication between the first and second annuli, fluid communication is substantially prevented between the annular area and each of the first and second annuli, and wherein the first and second packing elements provide redundant sealing, in that one of the first and second packing elements remains effective to seal if the other of the first and second packing elements fails to seal.

46. A packer, comprising:

spaced apart first and second packing elements on a single one piece generally tubular mandrel;

a hydraulically actuated setting mechanism positioned between the first and second packing elements; and an annular area being defined longitudinally between the first and second packing elements and radially between the packer and a borehole, and fluid communication being substantially prevented between the annular area and an interior of the mandrel.

47. The packer of claim 46, wherein the packer is free of any slips for gripping engagement with a borehole.

48. The packer of claim 46, wherein the setting mechanism includes inner and outer pistons which apply substantially equal but oppositely directed compression forces directly to the respective first and second packing elements.

49. The packer of claim 48, wherein the compression forces are applied from the inner and outer pistons to the respective first and second packing elements without being transmitted through any slip to grippingly engage a borehole.

50. The packer of claim 48, further comprising a mechanical locking mechanism which permits relative displacement between the inner and outer pistons in a first direction, but which prevents relative displacement between the inner and outer pistons in a second direction opposite to the first direction, and wherein the first and second packing elements load into each other via the locking mechanism.

51. The packer of claim 46, wherein the first and second packing elements collectively cover approximately ⅓of a length of the mandrel when the first and second packing elements are in an uncompressed state.

52. The packer of claim 46, wherein the first and second packing elements provide redundant sealing, in that one of the first and second packing elements remains effective to seal if the other of the first and second packing elements fails to seal.

53. The packer of claim 46, wherein a pressure differential applied across at least one of the first and second packing elements causes a compressive load to be applied to the other of the first and second packing elements.

54. A well system, comprising:

a packer positioned in a non-vertical open borehole, wherein the packer comprises:

an inner mandrel;

a first compressible packing element disposed around the inner mandrel;

a second compressible packing element disposed around the inner mandrel, wherein said first and second packing elements are spaced apart; and a hydraulic actuation mechanism disposed between the first and second packing elements, wherein said hydraulic actuation mechanism sets the packer by longitudinally compressing the first and second packing elements to seal an annulus in the borehole, and wherein the first and second packing elements provide redundant sealing, in that one of the first and second packing elements remains effective to seal if the other of the first and second packing elements fails to seal.

55. A well system, comprising:

a packer set in a horizontal open borehole, the packer including spaced apart first and second packing elements on a single generally tubular mandrel, and a hydraulically actuated setting mechanism positioned between the first and second packing elements, wherein the setting mechanism includes inner and outer pistons which apply substantially equal but oppositely directed compression forces directly to the respective first and second packing elements, wherein the packer further comprises a mechanical locking mechanism which permits relative displacement between the inner and outer pistons in a first direction, but which prevents relative displacement between the inner and outer pistons in a second direction opposite to the first direction, and wherein the first and second packing elements load into each other via the locking mechanism.

56. A well system, comprising:

a packer set in a horizontal open borehole, the packer including spaced apart first and second packing elements on a single generally tubular mandrel, and an annular area defined longitudinally between the first and second packing elements and radially between the packer and the open borehole, fluid communication being substantially prevented between the annular area and an interior of the mandrel; and a tubular string, the packer being interconnected in the tubular string, and spaced apart first and second annuli being defined radially between the tubular string and the open borehole, the first annulus and the annular area being substantially pressure isolated from each other by the first packing element, the second annulus and the annular area being substantially pressure isolated from each other by the second packing element, and wherein fluid communication is substantially prevented between the annular area and each of the first and second annuli.

57. A packer, comprising:

spaced apart first and second packing elements on a single one piece generally tubular mandrel;

a hydraulically actuated setting mechanism positioned between the first and second packing elements; and a mechanical locking mechanism which permits relative displacement between the inner and outer pistons in a first direction, but which prevents relative displacement between the inner and outer pistons in a second direction opposite to the first direction, and wherein the first and second packing elements load into each other via the locking mechanism.

* * * * *